US007565773B1

(12) United States Patent
Romig

(10) Patent No.: US 7,565,773 B1
(45) Date of Patent: Jul. 28, 2009

(54) HAZARDOUS MATERIAL STORAGE BUILDING

(75) Inventor: Frederick W. Romig, Wexford, PA (US)

(73) Assignee: Haz-Safe, LLC, Austintown, OH (US)

( * ) Notice: Subject to any disclaimer, the term of this patent is extended or adjusted under 35 U.S.C. 154(b) by 855 days.

(21) Appl. No.: 10/804,924

(22) Filed: Mar. 19, 2004

(51) Int. Cl.
*E04H 1/00* (2006.01)

(52) U.S. Cl. ..... 52/79.1; 52/169.5; 52/302.1; 588/259

(58) Field of Classification Search ..... 52/79.1, 52/169.4, 169.5, 220.1, 302.1, 192, 259, 52/163, 126.1; 454/185; 588/259; 210/163, 210/164

See application file for complete search history.

(56) References Cited

U.S. PATENT DOCUMENTS 3,005,205 A * 10/1961 Breen ..... 4/300
3,407,719 A * 10/1968 Temple et al. ..... 454/49
3,951,336 A * 4/1976 Miller et al. ..... 454/238
4,122,761 A * 10/1978 Westin et al. ..... 454/118
4,848,617 A * 7/1989 Zygaj ..... 220/1.5
4,909,227 A * 3/1990 Rieger ..... 126/531
4,922,557 A * 5/1990 Harding et al. ..... 4/477
4,938,124 A * 7/1990 Garza ..... 454/343
4,973,195 A 11/1990 Sweeney et al.
5,005,227 A * 4/1991 White ..... 4/449
5,030,033 A 7/1991 Heintzelman et al.
5,052,569 A * 10/1991 Cooper ..... 220/1.5
5,074,137 A * 12/1991 Harris et al. ..... 73/31.02
5,213,438 A 5/1993 Barenwald
5,248,220 A 9/1993 Rohringer
5,254,798 A 10/1993 Zoback
5,285,617 A 2/1994 Romig et al.
5,511,908 A 4/1996 Van Valkenburgh et al.
5,562,047 A 10/1996 Forney et al.
5,597,392 A * 1/1997 Hawkins et al. ..... 96/222
5,735,639 A 4/1998 Payne et al.
6,038,786 A * 3/2000 Aisenberg et al. ..... 34/267
6,305,131 B1 * 10/2001 Romig ..... 52/79.1
2003/0163973 A1 * 9/2003 Wood et al. ..... 52/900

OTHER PUBLICATIONS

Virginia Department of Transportation, "Road and Bridge Standards", vol. 1, 1996, Detail 104.09.

* cited by examiner

*Primary Examiner*—Richard E Chilcot, Jr.
*Assistant Examiner*—Anthony N Bartosik
(74) *Attorney, Agent, or Firm*—Eckert Seamans Cherin & Mellott, LLC; David C. Jenkins, Esq.

(57) ABSTRACT

A hazardous material storage facility is provided that includes an upper floor having openings therethrough, a lower floor that is sloped from an upper end to an elongated basin, at least one vent duct disposed beneath the upper floor and adjacent to the lower floor basin, the vent duct including vent openings structured to allow air and fumes to be introduced into the vent duct and a means for removing the air and fumes in the vent duct therefrom. In this configuration, air is drawn generally downwardly through the facility while hazardous vapors, which typically emanates from spilled hazardous materials on the lower floor, are located close to the vent duct.

1 Claim, 10 Drawing Sheets

HAZARDOUS MATERIAL STORAGE BUILDING

FIELD OF INVENTION

This invention relates to a hazardous material storage facility or a modular hazardous material storage facility and, more specifically, to a hazardous material storage facility having a vent system with a sensor disposed below the container supporting floor.

BACKGROUND OF THE INVENTION

Commonly owned U.S. Pat. Nos. 6,305,131; 6,223,473; 5,396,742; 5,301,479; and 5,285,617, all of which are expressly incorporated by reference herein, disclose various hazardous material storage buildings and features thereof.

Hazardous materials, such as chemicals or waste in either a solid or liquid form, are frequently placed in 55-gallon cylindrical barrels. These drums are typically further stored in a storage facility. Such drums, however, can easily develop leaks over time. Accordingly, these barrels must be kept in a facility that has suitable safety features such as proper venting, fire and explosion protection, leakage protection with a sump built into the floor, and leakage detection.

Because it is preferable to maintain barrels containing hazardous materials upright, metal hazardous material storage facilities are presently constructed with floors that are generally horizontal or flat. This can be a disadvantage as the leaked hazardous material tends to remain in the vicinity of the barrel. Therefore, to detect such a leak, a sensor must be located at each location where a barrel may be stored within the facility. Use of multiple sensors can be expensive, both to install and maintain. To reduce the need for multiple sensors, storage facilities have been designed with an upper floor with openings therethrough, e.g., a grating and a sloped lower floor. Any leaked hazardous material tends to fall through the upper floor and, in the case of liquids and heavier than air gases or vapor, gather at the low point of the lower floor. Thus, a limited number of liquid and/or vapor sensors may be placed adjacent to the low point of the lower floor and still detect a liquid leak from any barrel. These systems, however, have two disadvantages. First, such systems may not detect a small leak that does not have a sufficient volume to reach the sensor. That is, a small volume of leaked hazardous material may merely wet the sloped floor, but not spread to the trench or sensor. Second, certain systems may not include sensors to detect hazardous vapor.

Because hazardous liquids and solids materials, upon evaporation or sublimation, may create hazardous vapors or explosive vapors, a hazardous storage facility must also provide adequate ventilation. Typically, a continually running vent system powered by one or more fan assemblies replaces the air within the storage facility multiple times within an hour. Sensors structured to detect hazardous vapors, hereinafter "vapor sensors," are typically located within the ventilation system near the exhaust duct. While such a ventilation system is desirable for maintaining a safe atmosphere within the storage facility, the rapid exchange of air creates difficulties in detecting hazardous vapor. It is axiomatic that a sensor must be exposed to a detectable quantity of vapor before it may provide a warning of the vapor's presence. However, in a storage facility where the air is replaced rapidly, a hazardous vapor may not collect in a detectable quantity. This is especially true where the hazardous material has fallen to the lower floor and the vents and vapor sensors are located on the roof or on the upper portion of a wall. In this configuration, any hazardous vapor originating on the floor is diluted in air from the upper area of the facility prior to being passed through the vent and the vapor sensors. Thus, a leaking container may exist and not be detected by the sensor system. As with liquid sensors, use of multiple vapor sensors disposed throughout the facility can be expensive, both to install and maintain. Additionally, because the prior art systems tended to mix the hazardous vapor with the air in the facility prior to venting to the atmosphere, workers within the storage facility may be exposed to the hazardous vapor.

A disadvantage of the prior art hazardous vapor detection systems was that the air flow through the facility had to be strictly controlled. That is, the prior art systems typically had an intake fan and an exhaust fan. The two fans were located at opposite sides of the facility. Thus, a cross flow was created. One problem with the cross flow pattern was that the pattern could be easily disrupted by a breach in the facility walls, e.g., an open door. That is, if a door adjacent to the exhaust fan was left ajar, air would flow in through the door and immediately be exhausted through the exhaust fan. This could allow a dangerous amount of hazardous vapors to accumulate in the facility that would remain undetected as the hazardous vapors never reached the sensor adjacent to the exhaust fan.

There is, therefore, a need for a vapor sensor system for a hazardous material storage facility structured to collect air from locations prone to collecting leaked hazardous material.

There is a further need for a vapor sensor system for a hazardous material storage facility that is structured to draw hazardous vapors away from the portion of the facility that may be occupied by humans.

There is a further need for a hazardous material storage facility which provides a device structured to removing hazardous vapor therefrom while limiting the amount of hazardous vapor mixed with the hazardous material storage facility air.

SUMMARY OF THE INVENTION

These needs, and others, are met by the present invention which provides a hazardous material storage facility having an upper grating floor, a sloped lower floor, and a hazardous vapor detection system. The hazardous vapor detection system includes an air inlet fan, a duct having vent openings. The air inlet fan is disposed above the upper floor. The duct is disposed beneath the upper floor and above the lower floor at a location adjacent to the lowest portion of the lower floor. When a spill occurs, liquids will flow down the sloped floor to the lowest point on the floor. Similarly, heavier than air gases will tend to flow to the low point, however, gases and vapors are also subject the force of air currents. The vent openings allow air and fumes, including hazardous vapor and/or gases, hereinafter referred to simply as vapor, present in the facility to be introduced into the vent duct. The vent system further includes an exhaust fan and an exhaust opening, located outside of the building. The exhaust fan removes the air and fumes from the vent duct and expels the air and fumes to the atmosphere. A vapor sensor is disposed within the duct adjacent to the exhaust opening and is structured to detect hazardous vapor.

In operation, the hazardous vapor detection system generally draws air from the hazardous material storage facility downwardly through the hazardous material storage facility to the area below the upper floor. Air between the upper floor and the lower floor is also drawn through the vent openings and passed over the vapor sensor before being expelled. Because a leaked hazardous material is likely to have fallen through the upper floor onto the lower floor, the hazardous vapor will be more concentrated adjacent to the lower floor. The concentrated vapors are also drawn through the vent openings and passed over the vapor sensor before being expelled. Because the hazardous vapors are concentrated, the vapor sensor of the present invention is more likely to detect a smaller quantity of hazardous vapors. A smaller quantity of hazardous vapor is typically associated with a smaller leak of hazardous materials. Additionally, because the hazardous vapor detection system of the present invention draws the air in the hazardous material storage facility downwardly, a worker in the upper area of the hazardous material storage facility is less likely to be exposed to hazardous vapor from hazardous material spilled on the lower floor.

In a preferred embodiment, the lower floor includes a trench at the lowest point of the lower floor. Spilled hazardous liquid and any heavier than air vapor tends to collect in the trench. The vent duct is disposed adjacent to, and preferably above, the trench. As such, the vent duct is disposed adjacent to a location especially prone to collect leaked hazardous material.

An additional advantage of the present system is that the intake fan may be disposed at any location in the facility. That is, because the air and fumes are being drawn downwardly, the intake fan does not have to direct air flow across the floor. Moreover, because the air flow is towards the lower floor, the flow pattern created by the intake and exhaust fans is not affected by additional openings in the facility walls, e.g., an open door. That is, if a door is accidentally left open, air will merely flow through the door, down to the lower floor and exit the facility through the hazardous vapor detection system.

BRIEF DESCRIPTION OF THE DRAWINGS

FIG. 3 shows alternate configurations of the channel. Specifically.

FIG. 8 is a cross sectional view of alternate embodiments. Specifically.

DESCRIPTION OF THE PREFERRED EMBODIMENT

Figure 1:
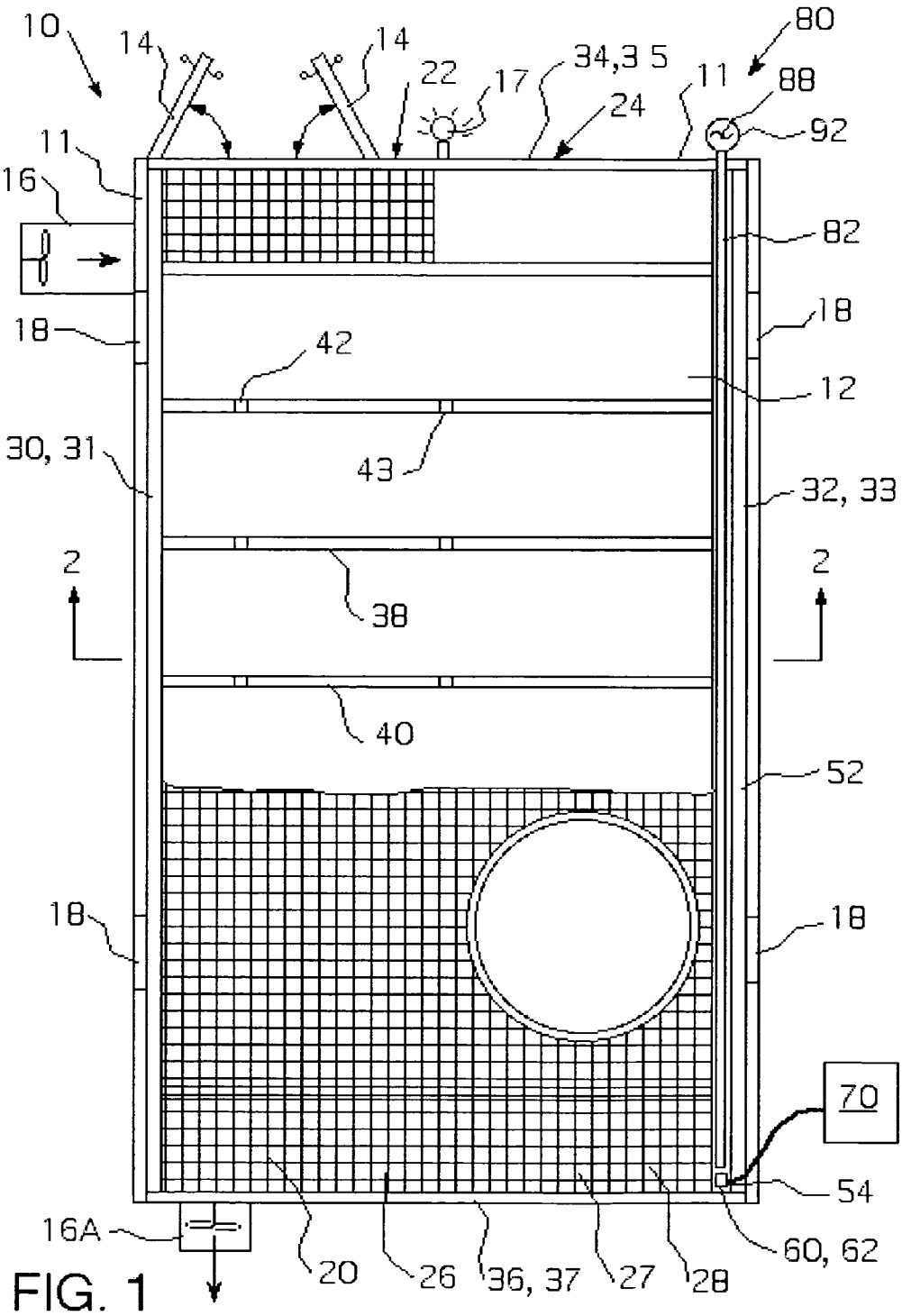
FIG. 1 is a partially cut-away top view of a hazardous material storage facility according to the present invention.
Figure 2:
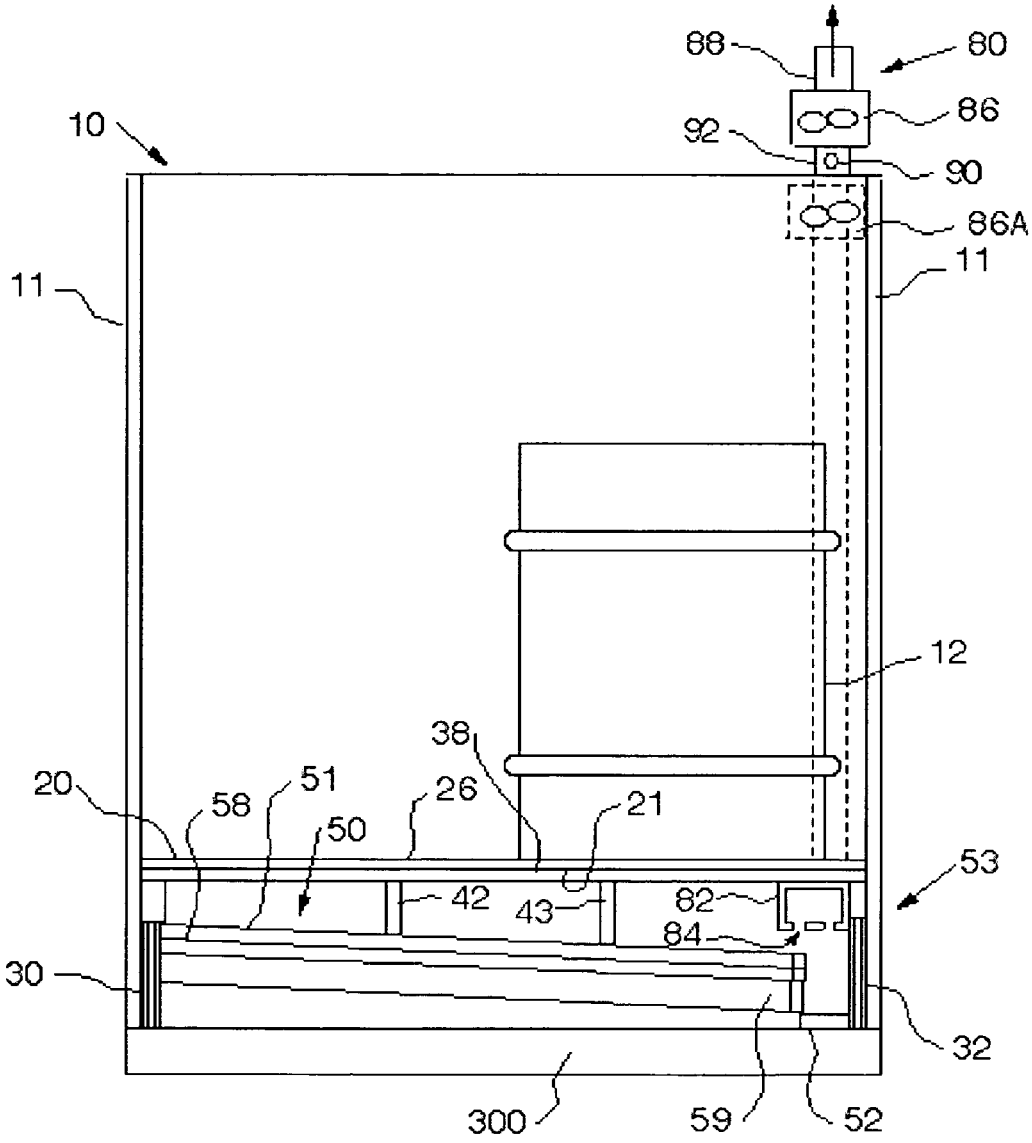
FIG. 2 is a side view of a hazardous material storage facility according to the present invention taken along line 2-2 of FIG. 1.

A metal hazardous material storage facility 10 according to the present invention is shown in FIGS. 1 and 2. Although a facility 10 of any shape may be used with this invention, in the preferred embodiment, the facility 10 has a rectangular floor plan having a length and a width. The facility 10 incorporates a dual floor structure which includes an upper floor 20 and a lower floor 50 which are both disposed above a foundation 300. The facility 10 further includes lateral walls 11 extending generally vertically from foundation 300, doors 14 in walls 11, as well as safety features such as, an intake fan 16 for providing positive pressure into the facility 10, warning lights 17, emergency vents 18 and may include an emergency exhaust fan 16A. These elements are well known in the prior art. The safety features may be controlled by the spill detection system 70 (shown hereinafter) according to a predetermined protocol.

The upper floor 20 is divided into an aisle portion 22 and a storage portion 24. Both the aisle portion 22 and the storage portion 24 have upper floor surfaces 26, 27 with openings 28 therethrough. In the preferred embodiment, the upper floor surfaces 26, 27 are either steel grating or diamond plate. In the preferred embodiment, the aisle portion 22 extends the length of the facility 10 with the storage portion 24 on at least one side of the aisle portion 22. Upper floor 20 supports a container 12 of hazardous material. Container 12 is typically in the form of a steel cylindrical barrel having a diameter of about twenty inches to twenty-three and one-half inches and a height of about two to four feet. Container 12 typically holds fifty-five gallons of hazardous material. Hazardous material can include solid and liquid hazardous chemicals or waste.

The upper floor 20 is disposed above the lower floor 50 and supported by members 30, 32, 34, and 36 which extend about the perimeter of facility 10 and define the outer boundary of the storage portion 24 and aisle portion 22 of the facility 10. Upper floor support members 30, 32 extend the length foundation 300. Upper floor support members 34, 36 extend the width of foundation 300 and are generally perpendicular to upper floor support members 30, 32. Upper floor support members 30, 32, 34, 36 each have an upper surface 31, 33, 35, and 37. Upper floor support members 30, 32, 34, 36 are disposed on top of foundation 300. Upper floor support cross beams 38, 40, extending parallel to members 34, 36, may also be included. As shown on FIG. 2, upper floor support cross beams 38, 40 are disposed above lower floor 50 and may be supported by intermittent supports 42, 43. Supports 42, 43, which rest on lower floor 50 (described below), may be of different heights as required to ensure upper floor 20 is generally horizontal. In the preferred embodiment, upper floor support member 30, 32, 34, and 36 are hollow, rectangular tubular members, and upper floor support cross beams 38, 40 are inverted L-shaped beams.

Lower floor 50 has a surface 51 sloped in at least one direction having an upper end 58 and a lower end 59. In the preferred embodiment, lower floor 50 is a floor plan having a length and a width. The facility 10 incorporates a dual floor structure which includes an upper floor 20 and a lower floor 50 which are both disposed above a foundation 300. The upper floor 20 is divided into an aisle portion 22 and a storage portion 24. Both the aisle portion 22 and the storage portion 24 have upper floor surfaces 26, 27 with openings 28 therethrough. In the preferred embodiment, the upper floor surfaces 26, 27 are either steel grating or diamond plate. In the preferred embodiment, the aisle portion 22 extends the length of facility 10 with a storage portion 24 on at least one side of the aisle portion 22. Upper floor 20 supports a container 12 of hazardous material. Container 12 is typically in the form of a steel cylindrical barrel having a diameter of about twenty inches to twenty-three and one-half inches and a height of about two to four feet. Container 12 typically holds fifty-five gallons of hazardous material. Hazardous material can include solid and liquid hazardous chemicals or waste.

The upper floor 20 is disposed above the lower floor 50 and supported by members 30, 32, 34, and 36 which extend about the perimeter of facility 10 and define the outer boundary of the storage portion 24 and aisle portion 22 of the facility 10. Upper floor support members 30, 32 extend the length foundation 300. Upper floor support members 34, 36 extend the width of foundation 300 and are generally perpendicular to upper floor support members 30, 32. Upper floor support members 30, 32, 34, and 36 each have an upper surface 31, 33, 35, and 37. Upper floor support members 30, 32, 34, 36 are disposed on top of foundation 300. Upper floor support cross beams 38, 40, extending parallel to members 34, 36, may also be included. As shown on FIG. 2, upper floor support cross beams 38, 40 are disposed above lower floor 50 and may be supported by intermittent supports 42, 43. Intermittent supports 42, 43, which rest on lower floor 50 (described below), may be of different heights as required to ensure the upper floor 20 is generally horizontal. In the preferred embodiment, upper floor support members 30, 32, 34, and 36 are hollow, rectangular tubular members, and upper floor support cross beams 38, 40 are inverted L-shaped beams.

Figure 3A:
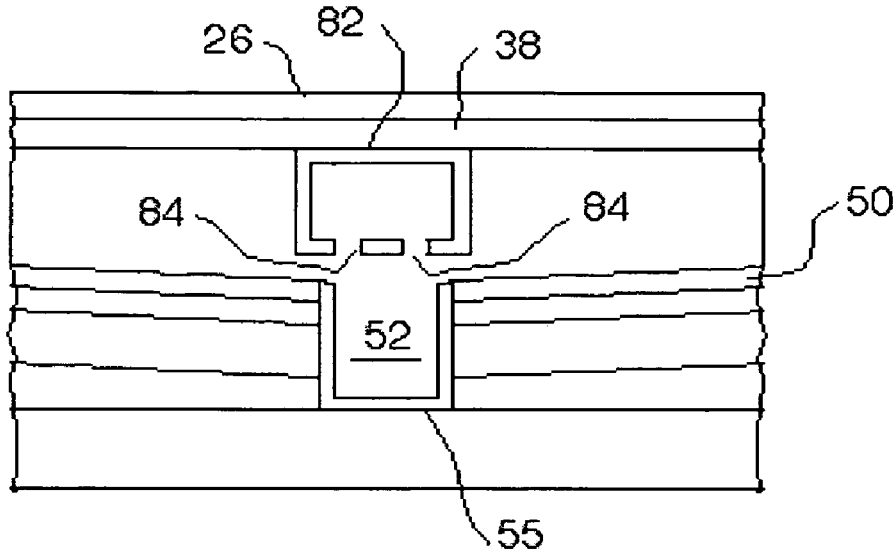
FIG. 3A shows a U-shaped channel and FIG. 3B shows a V-shaped channel.
Figure 3B:
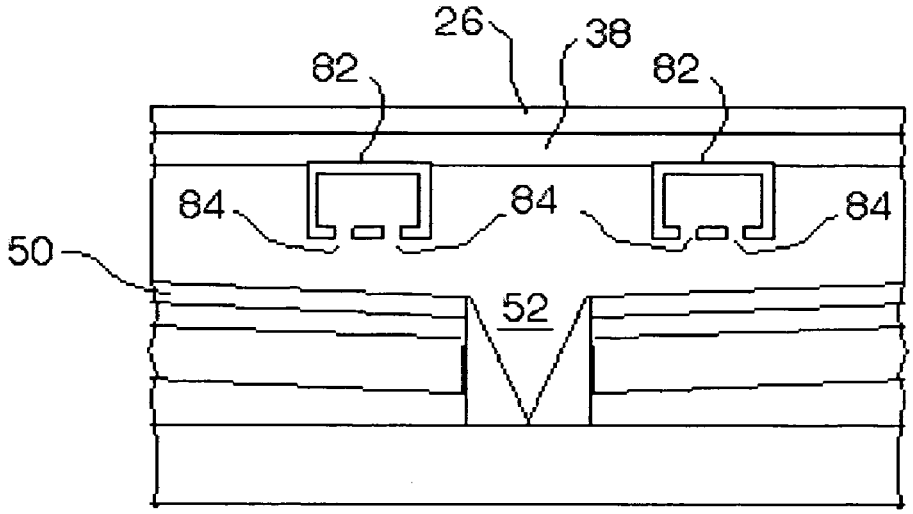
Figure 8A:
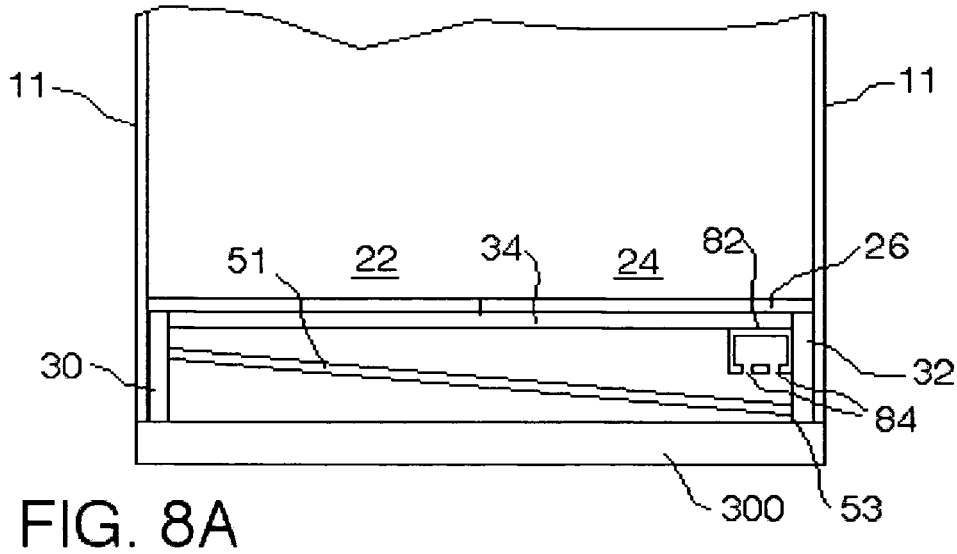
FIG. 8*a* shows a view of the sloped floor without a channel.

Lower floor 50 has a surface 51 sloped in at least one direction having an upper end 58 and a lower end 59. In the preferred embodiment, lower floor 50 is sloped in a direction generally parallel to upper floor support beams cross breams 38, 40. The low end 59 of the lower floor 20 is an elongated basin 53 into which liquid will flow (FIG. 8A). As shown in FIG. 2, preferably, the elongated basin 53 includes a channel 52, which is sloped in a direction generally perpendicular to the slope of the lower floor 50. That is, channel 52 is sloped in a direction parallel to members 30, 32. The channel 52 is created by a U-shaped member 55, as shown in FIG. 3A. However, as shown in FIG. 3B, any shape channel, e.g., a V-shaped channel, is acceptable. As shown in FIG. 1, the lower end of channel 52 is the lowest point 54 of the lower floor 50. The upper end 58 is at least one inch higher than lower end 59. In the rectangular facility 10 of the preferred embodiment, the length of the storage portion 24 and aisle portion 22 is about seventy-two feet and the lower floor 50 has a width of about fifteen feet. With these limitations, at least one gallon of liquid hazardous material spilled anywhere in the aisle portion 22 or the storage portion 24 will result in a detectable amount of liquid gathering of the lowest point 54 of channel 52.

Figure 4:
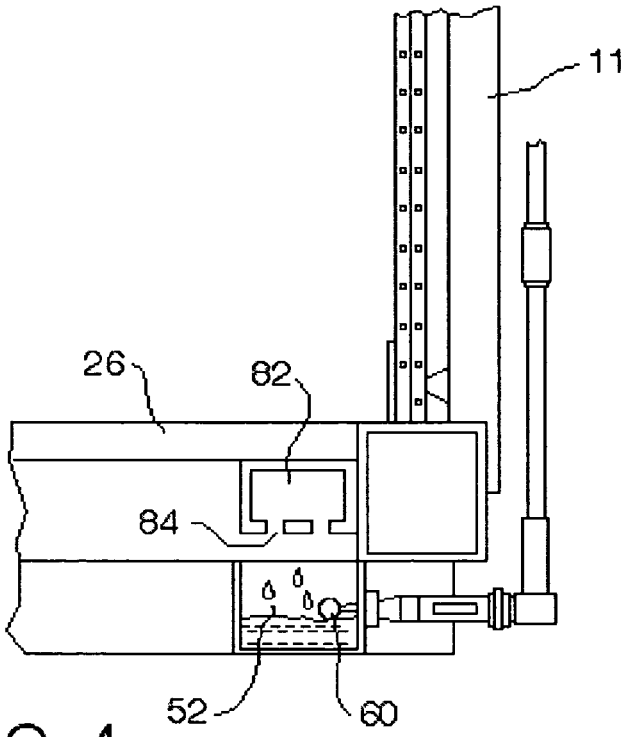
FIG. 4 shows a detail of the float sensor and one embodiment of the vent duct.

As shown in FIG. 4 a liquid sensor 60 is disposed at the lowest point 54 of channel 52. The sensor 60 generates an output signal when exposed to liquid. The sensor 60 is, preferably, a float sensor. However, any type of sensor, such as an infrared sensor can be used. To accommodate the float liquid sensor 60, the lowest point 54 may include a sensor pit 62 (shown in FIG. 1) extending below channel 52. The output signal from the liquid sensor 60 cooperates with a spill detection system 70 which controls other safety devices such as vents 18 and warning lights 17. When the spill detection system 70 receives an output signal from the liquid sensor 60, vents 18 and warning lights 17 are activated according to a predetermined protocol. A drain 66 may be located adjacent to the liquid sensor 60. The drain 66 communicates with a storage tank (not sown) located outside of the facility 10.

As shown in FIGS. 1 and 2, in addition to the liquid sensor 60, the facility 10 is provided with a hazardous vapor detection system 80. The hazardous vapor detection system 80 includes at least one vent duct 82 having a plurality of vent openings 84 therein, and a means for removing air and fumes. The means for removing air and fumes includes at least one exhaust fan 86, an exhaust opening 88, located outside of the walls 11, and a vapor sensor 90. The vent duct 82 is disposed adjacent to the channel 52. In the preferred embodiment, shown in FIG. 2, there is a single vent duct 82 coupled to the bottom side 21 of the upper floor 20 directly above the channel 52. The vent duct 82 preferably extends the length of the facility 10. The vent duct 82 extends beyond the walls 11 and, may include a vertical chimney 92. The vent openings 84 are disposed along the lateral and lower sides of the vent duct 82. There is at least one exhaust fan 86, and preferably a second, backup exhaust fan 86A, disposed adjacent to the exhaust opening 88. The exhaust fan 86 is structured to draw air and fumes, which includes hazardous vapors, through the vent duct 82 and pass the air and fumes through the exhaust opening 88 to the atmosphere. The vapor sensor 90 is, preferably, disposed upstream of, and adjacent to, the exhaust fan 86. The vapor sensor 90 is structured to detect one or more types of hazardous vapors and provide an output signal.

Figure 5:
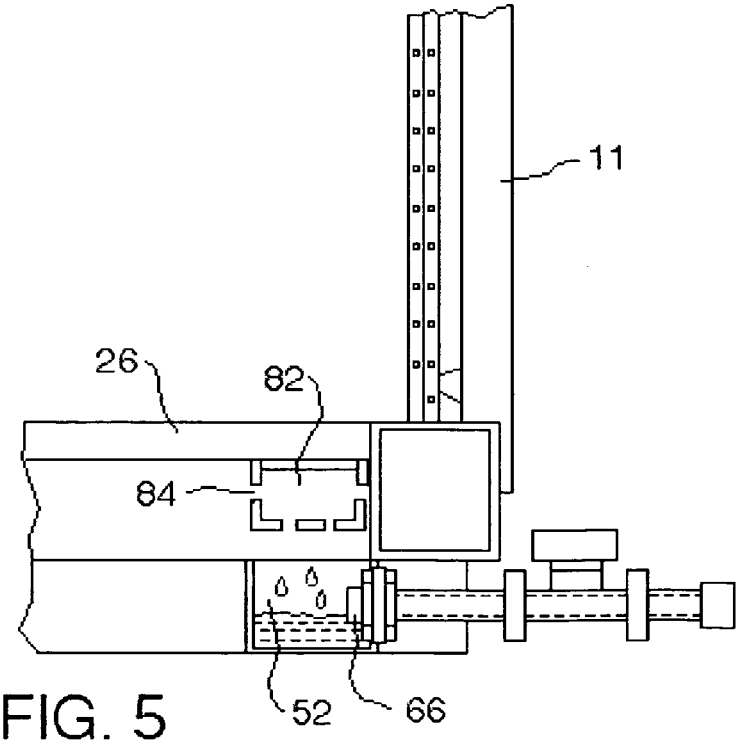
FIG. 5 shows a detail of the sump drain and another embodiment of the vent duct.
Figure 12:
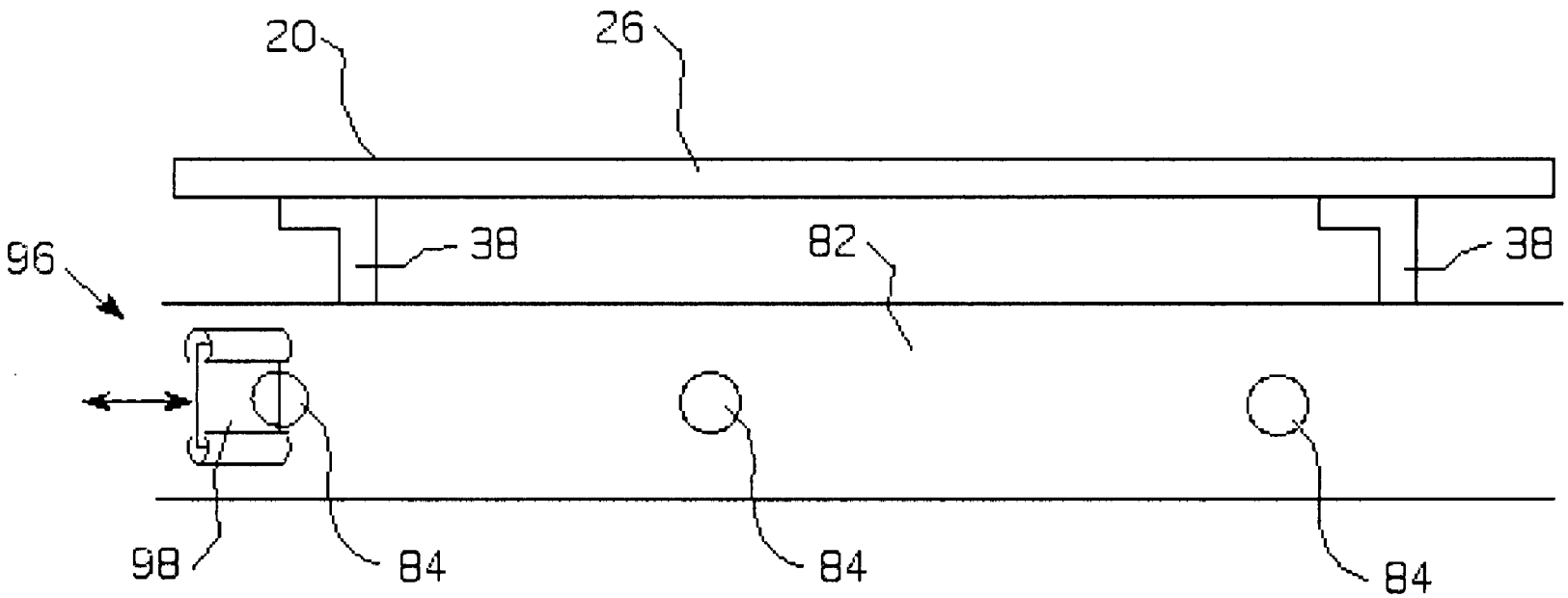
FIG. 12 is a side view of a flow control device.

In the preferred embodiment, shown in FIG. 4, the vent openings 84 are disposed only on the lower side of the vent duct 82 so that liquid may not enter the vent duct 82. However, as shown in FIG. 5, vent openings 84 may also be disposed on the sides of the vent duct 82. Additionally, the vent openings 84 may include a flow control structure 96 to adjust the amount of fluid flow through the opening. The flow control structure 96 may merely be larger openings at locations which are at a greater distance from the exhaust fan 86. However, as shown in FIG. 12, in the preferred embodiment, the flow control structure 96 is an adjustable gate 98 that may be selectively moved across the vent opening 84 thereby adjusting the exposed area of the vent opening 84.

In operation, the intake fan draws air from the atmosphere into the facility 10. The exhaust fan 86 draws air and fumes from the area above the upper floor 20 and the area between the upper floor 20 and the lower floor 50 into the vent duct 82 through the vent openings 84. For air and fumes above the upper floor 20, the direction of the flow is generally downwardly through the upper floor openings 28. The air and fumes are drawn through the vent duct 82 and passed over the vapor sensor 90 before being expelled from the facility 10 through exhaust opening 88. Because a leaked hazardous material is likely to have fallen through the upper floor 20 onto the lower floor 50, the hazardous vapor will, typically, be more concentrated adjacent to the lower floor 50. The hazardous vapors are drawn through the vent openings 84 and passed over the vapor sensor 90 before being expelled. As with the liquid sensor 60, the output signal from the vapor sensor 90 cooperates with a spill detection system 70 which controls other safety devices such as vents 18 and warning lights 17. When the spill detection system 70 receives an output signal from vapor sensor 90, vents 18 and warning lights 17 are activated according to a predetermined protocol.

Figure 6:
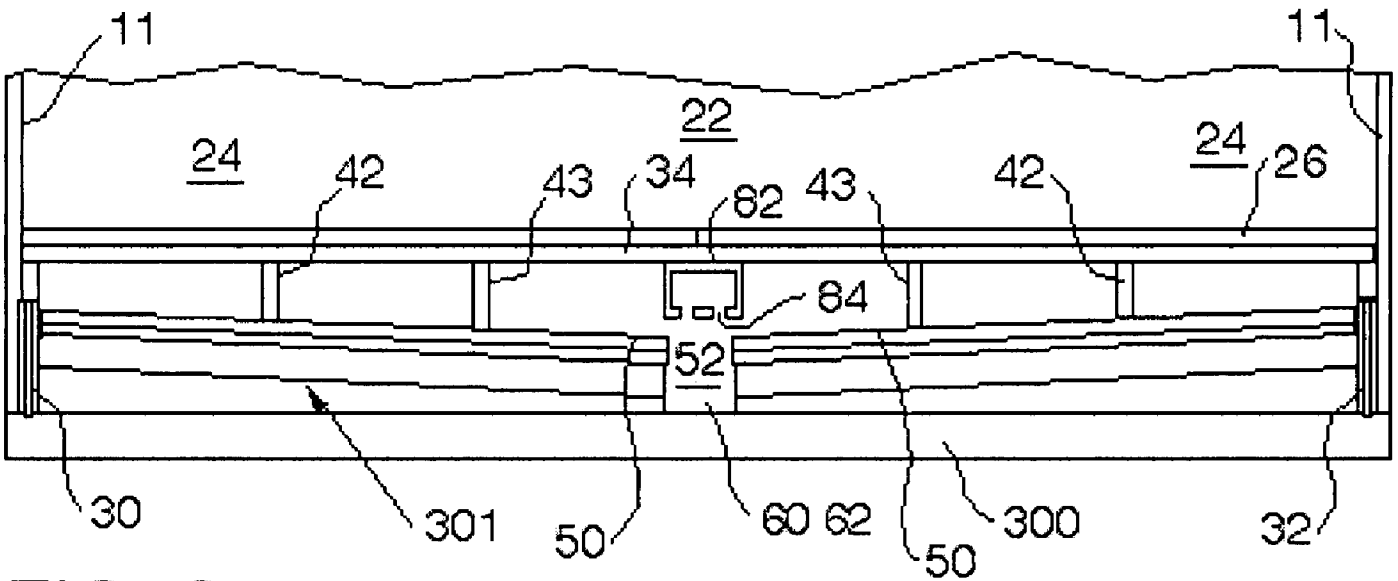
FIG. 6 is a cross sectional view of an alternate embodiment having two storage portions.

The invention may be practiced with a facility 10 having an alternative floor plan. In the most preferred embodiment, shown in FIG. 6, facility 10 includes two storage portions 24 on the upper floor 20 located on either side of aisle portion 22. Below each storage portion is a sloped lower floor 50. Each sloped lower floor 50 is sloped down to a central channel 52 located generally below the center of aisle portion 22. As before, channel 52 is sloped in a direction perpendicular to lower floors 50. In this embodiment, as shown in FIG. 3A, the vent duct 82 is disposed in the central part of the facility just above the channel 52. The remaining components of the hazardous vapor detection system 80 are substantially similar to those described above. Alternatively, as shown in FIG. 3B, the hazardous vapor detection system 80 may include multiple vent ducts 82; two are shown. Here the two vent ducts 82 are disposed on either side of the channel 52. In this configuration the channel 52 is visible from directly above so that spills may be seen and the fire suppression system may apply a fire suppressant to the channel 52 directly from above.

Figure 7:
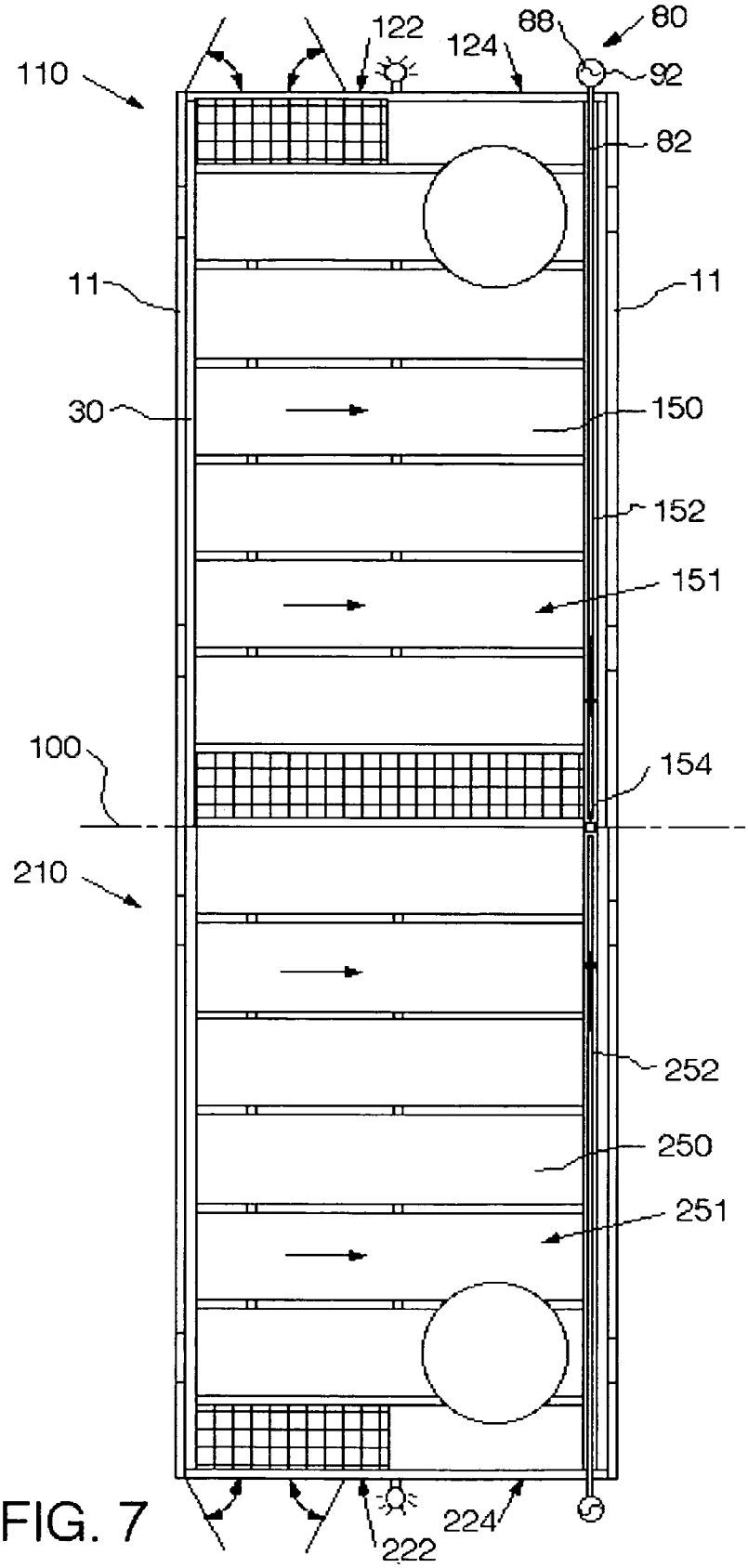
FIG. 7 is a top view of an alternate embodiment having multiple sections.

Additionally, the floor plan described above may be mirrored, or duplicated, within one facility 10. That is, the facility 10 may be modular, having sections generally pre-built and structured to be joined together. An example of a facility 10 having mirrored storage areas is shown in FIG. 7. The facility 10 may have two leg modules, 110, 210 each with an aisle portion 122, 222, and each with storage portions 124, 224 located on one side of aisle portions 122, 222. The legs, 110, 210 are joined at a central line 100. The lower floors 150, 250 below each aisle portion 122, 222 and storage portion 124, 224 have a contiguous sloped surface 151, 251. Channels 152, 252 are sloped toward central line 100, with the lowest point 154 located along central line 100. As detailed above, a liquid sensor 160 is located at the lowest point 154 in channels 152, 252. In this embodiment, the vent duct 82 is disposed just above the each channel 152, 252. The remaining components of the hazardous vapor detection system 80 are substantially similar to those described above. A facility 10 according to this invention with more than two legs can be constructed.

An alternative embodiment of this invention can be constructed wherein the lower floor 50 does not include a channel 52. As shown in FIG. 8A, in an embodiment having a single storage portion 24 disposed adjacent to an aisle portion 22. Thus, there is not a single lowest point 54, but rather an elongated low basin 53 extending adjacent to the wall 11. In this embodiment, the vent duct 82 is disposed in the central part of the facility 10 just above the basin 53. The remaining components of the hazardous vapor detection system 80 are substantially similar to those described above.

Figure 8B:
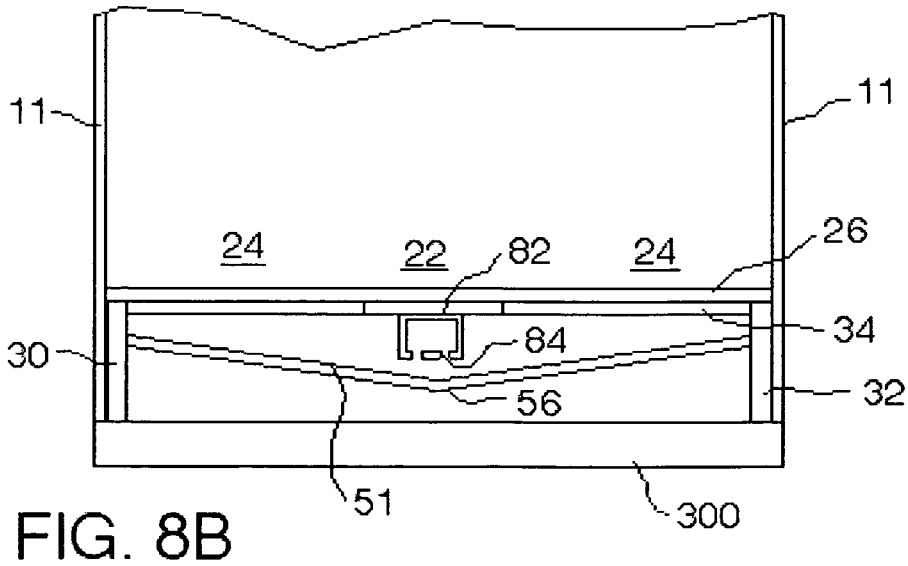
FIG. 8B shows a cross sectional view of a facility having two storage portions without a channel.

Alternatively, in an embodiment having two storage portions 24 located on either side of aisle 22, as shown in FIG. 8B, but without a channel 52, a first and second the lower floor portions slope towards each other and meet at a vertex 56 generally below aisle 22. That is, the basin 53 lies along the vertex 56. In this embodiment, the vent duct 82 is disposed in the central part of the facility 10 just above the vertex 56. The remaining components of the hazardous vapor detection system 80 are substantially similar to those described above.

Figure 9:
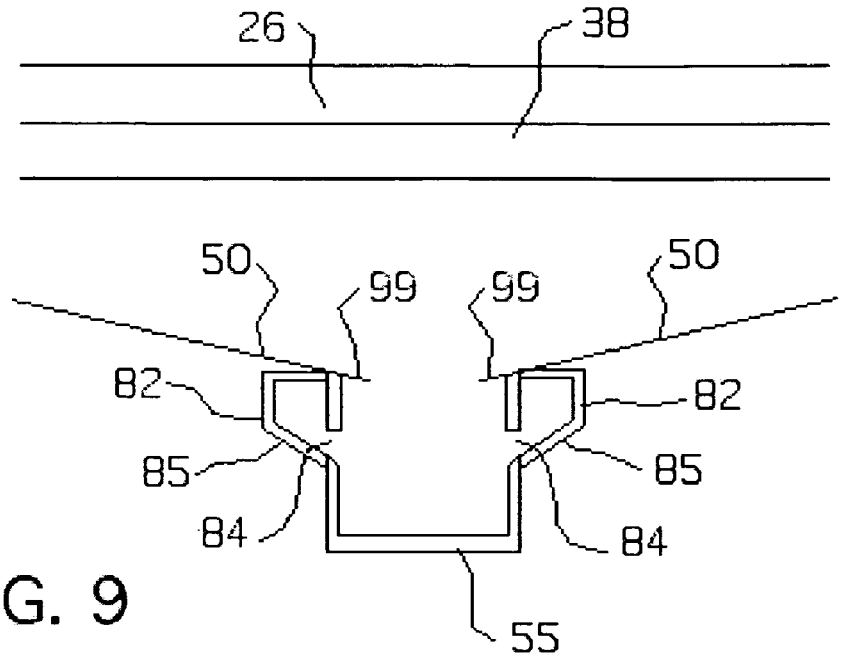
FIG. 9 is a cross-sectional view of an alternate embodiment of the hazardous vapor detection system.

In addition to having the hazardous vapor detection system 80 operate with various configurations of floor plans, the vent duct 82 may be in various configurations. As noted above, there may be more than one vent duct 82 as shown in FIG. 3B. As shown in FIG. 9, a vent duct 82 may also be disposed below the lower floor 50, but above the bottom of the channel 52, with the vent openings 84 extending through the upper portion of the U-shaped member 55. Preferably, there are two vent ducts 82, one disposed on each side of the U-shaped member 55. To resist collection liquid in the vent duct 82, in this embodiment, the lower wall 85 of the vent duct 82 is sloped toward the channel 52. Also, the openings 84 are located at the lowest point on the vent duct 82. Additionally, the channel 52 may include turbulators 99. The turbulators 99 are lips that extend from the lower floor over the channel 52. As air and fumes are drawn by the exhaust fan 86 over the turbulators 99, a turbulent airflow is created. Such a turbulent air flow will tend to draw vapor off of any hazardous material in the channel 52 thereby increasing the chance of the vapor sensor 90 detecting the hazardous vapors.

Figure 10:
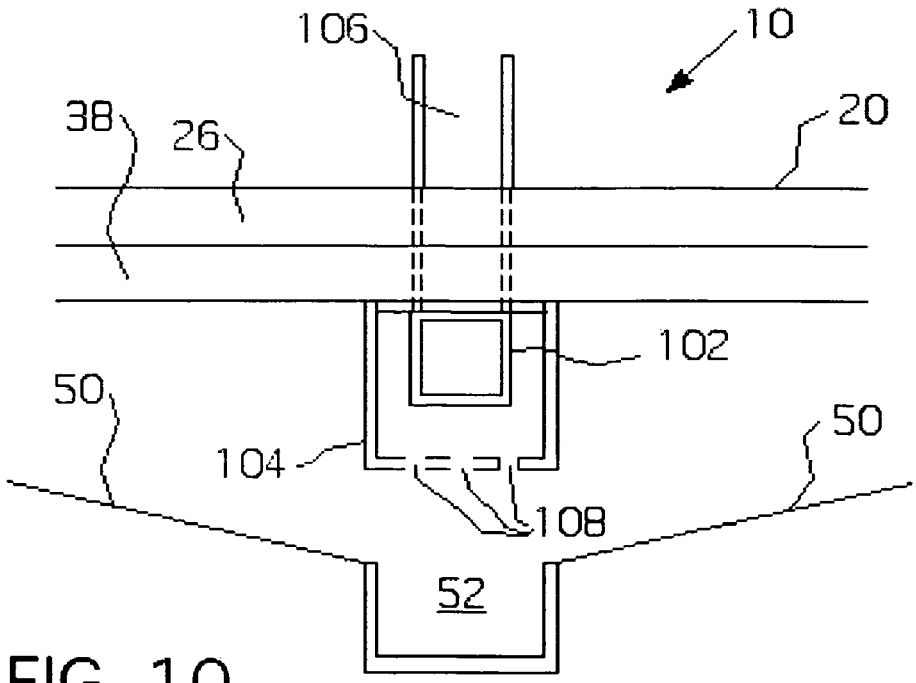
FIG. 10 is a cross-sectional view of an alternate embodiment of the hazardous vapor detection system.
Figure 11:
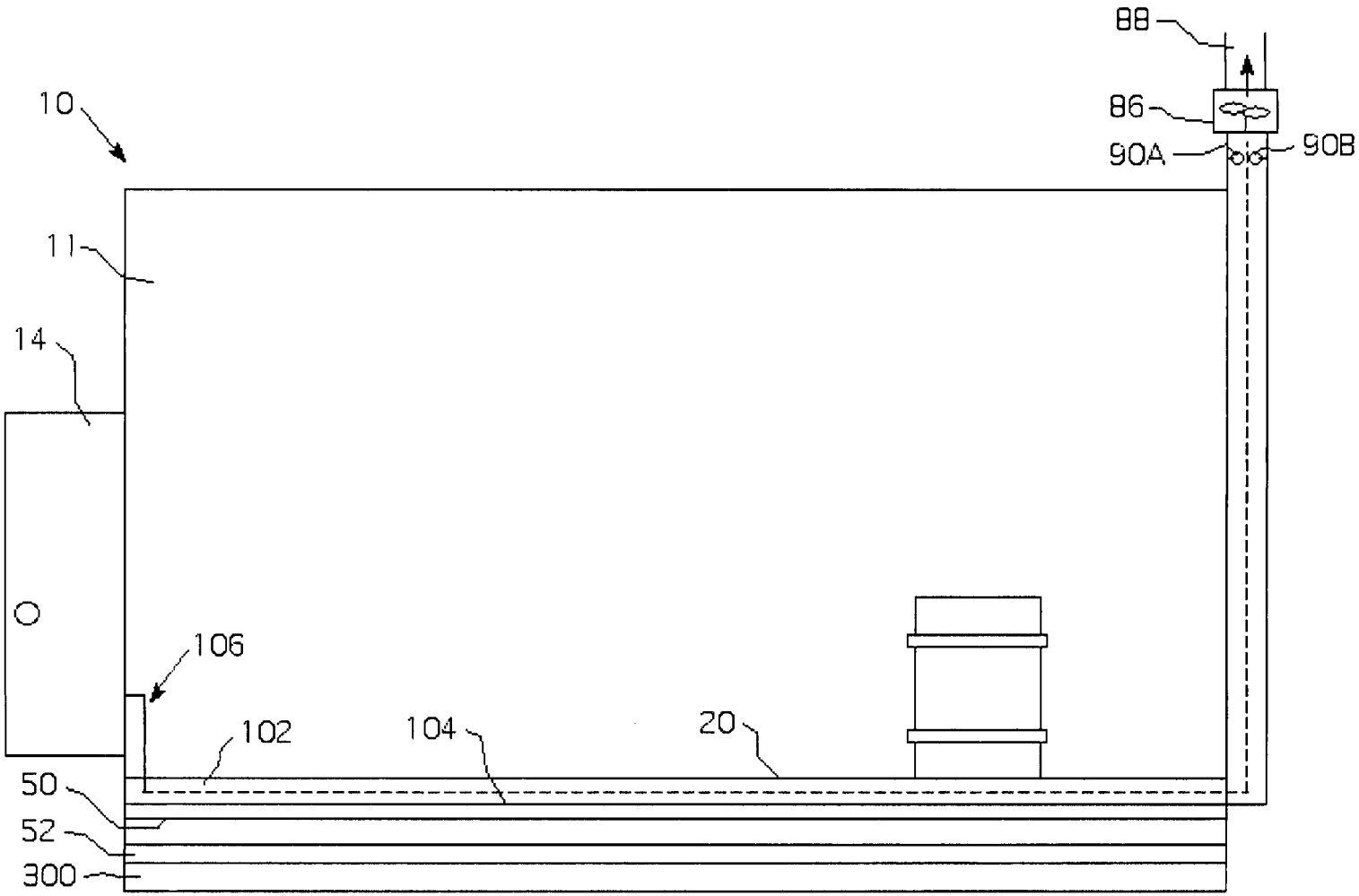
FIG. 11 is a side view of an alternate embodiment of the hazardous vapor detection system.

Another embodiment hazardous vapor detection system 80 is shown in FIGS. 10 and 11. In this embodiment, the vapor detection system 80 includes an inner vent duct 102 disposed within an outer vent duct 104. The inner vent duct 102 includes an intake duct 106. The intake duct 106 extends above the upper floor 20 and is structured to draw air primarily from the upper portion, i.e., the portion above the upper floor 20, of the hazardous material storage facility 10. The outer vent duct 104 includes vent openings 108. Thus, air and fumes from the area between the lower floor 50 and the upper floor 20 are drawn primarily through the outer vent duct 104. The inner and outer vent ducts 102, 104 are merged adjacent to the exhaust opening 88. While a single vapor sensor 90 may be positioned downstream of the merge point, it is preferred to have two sensors 90A, 90B, one disposed in the outer vent duct 104 and one disposed in the inner vent duct 102. In this configuration, air and fumes drawn from the space between the upper floor 20 and the lower floor 50 is generally not diluted with air and fumes from the upper portion of the hazardous material storage facility 10.

While particular embodiments of the invention have been disclosed above for purposes of illustration, it will be evident to those skilled in the art that numerous variations of the details may be made without departing from the invention as defined in the appended claims.

What is claimed is:

1. A hazardous material storage facility comprising: an upper floor having openings therethrough; a lower floor that is sloped from an upper end to an elongated basin; at least one vent duct disposed beneath the upper floor and adjacent to the lower floor basin, the vent duct including vent openings structured to allow air and fumes to be introduced into the vent duct; and means for removing the air and fumes in the vent duct therefrom;

wherein the elongated basin includes a channel disposed at the bottom of the basin;

wherein said at least one vent duct is disposed below said lower floor and above the bottom of said channel, said vent openings extending between said at least one vent duct and said channel, and wherein said lower floor includes a turbulator comprising at least one protuberance extending partially across said channel.

* * * * *